US011372370B2

(12) United States Patent
Peter

(10) Patent No.: US 11,372,370 B2
(45) Date of Patent: Jun. 28, 2022

(54) TIMEPIECE WHEEL SET WITH A UNIDIRECTIONAL WHEEL

(71) Applicant: Blancpain SA, Le Brassus (CH)

(72) Inventor: Julien Peter, Gollion (CH)

(73) Assignee: Blancpain SA, Le Brassus (CH)

( * ) Notice: Subject to any disclaimer, the term of this patent is extended or adjusted under 35 U.S.C. 154(b) by 925 days.

(21) Appl. No.: 16/163,020

(22) Filed: Oct. 17, 2018

(65) Prior Publication Data

US 2019/0163134 A1 May 30, 2019

(30) Foreign Application Priority Data

Nov. 24, 2017 (EP) ..... 17203600

(51) Int. Cl.
*G04B 11/02* (2006.01)
*G04B 1/16* (2006.01)
(Continued)

(52) U.S. Cl.
CPC ..... *G04B 11/022* (2013.01); *G04B 1/14* (2013.01); *G04B 1/16* (2013.01); *G04B 11/008* (2013.01); *G04B 3/04* (2013.01)

(58) Field of Classification Search
CPC ..... G04B 11/022; G04B 1/14; G04B 1/16; G04B 11/008; G04B 11/00; G04B 11/02; G04B 11/028
See application file for complete search history.

(56) References Cited

U.S. PATENT DOCUMENTS 3,838,567 A * 10/1974 Giger ..... G04B 11/006 968/83
5,303,213 A * 4/1994 Kaelin ..... G04B 11/02 368/185

(Continued)

FOREIGN PATENT DOCUMENTS

CH 705 322 A2 1/2013
CN 101055461 A 10/2007

(Continued)

OTHER PUBLICATIONS

Combined Chinese Office Action and Search Report dated Jun. 22, 2020 in Chinese Patent Application No. 201811306308.3, 6 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

Timepiece wheel set with a unidirectional wheel rotating in only one direction in cooperation with a ratchet wheel, which is movable inside a ratchet wheel chamber, comprising a click that rotates integrally with this wheel, which forms a one-piece component comprising at least one spring-arm, at the end of which, on a first side, a beak cooperates directly with the toothing of a ratchet wheel in an operating position in which this spring-arm is free, and on a second side, a first hook can cooperate with a second hook of complementary shape, comprised in this one-piece click, in a rest position in which this spring-arm is in an extended position, the elasticity thereof allowing this first hook to be hooked or unhooked with respect to this second hook by the action of an operator, by maximum elongation of this spring-arm and/or by the tilting of this end.

10 Claims, 2 Drawing Sheets

(51) Int. Cl.

| | |
|---|---|
| ***G04B 1/14*** | (2006.01) |
| ***G04B 11/00*** | (2006.01) |
| ***G04B 3/04*** | (2006.01) |

(56) References Cited

U.S. PATENT DOCUMENTS

| | | | | |
|---|---|---|---|---|
| 5,835,805 | A | 11/1998 | Izaki et al. | |
| 7,823,476 | B2 * | 11/2010 | Chaignat | G04B 27/04 368/146 |
| 9,298,163 | B2 * | 3/2016 | Decosterd | G04B 11/003 |
| 9,400,487 | B2 * | 7/2016 | Goeller | G04B 5/06 |
| 9,811,053 | B2 * | 11/2017 | Kirchhof | G04B 11/006 |
| 2008/0245171 | A1 * | 10/2008 | Chaignat | F16H 1/003 74/434 |
| 2011/0299366 | A1 * | 12/2011 | Giacobino | F16D 41/18 192/45.1 |
| 2012/0186054 | A1 | 7/2012 | Cusin et al. | |

FOREIGN PATENT DOCUMENTS

| | | | | |
|---|---|---|---|---|
| CN | 201698166 | U | 1/2011 | |
| CN | 102467071 | A | 5/2012 | |
| CN | 102621870 | A | 8/2012 | |
| CN | 105700324 | A | 6/2016 | |
| CN | 107003640 | A | 8/2017 | |
| DE | 1 922 475 | | 8/1965 | |
| DE | 10 2008 051 197 | A1 | 4/2010 | |
| EP | 2 482 143 | A1 | 8/2012 | |
| FR | 1 447 911 | | 8/1966 | |
| JP | 9-281574 | A | 10/1997 | |
| WO | WO-2013014515 | A1 * | 1/2013 | F16D 41/12 |

OTHER PUBLICATIONS

European Search Report dated May 15, 2018 in European application 17203600.6 filed on Nov. 24, 2017 (with English Translation of categories cited documents).

* cited by examiner

TIMEPIECE WHEEL SET WITH A UNIDIRECTIONAL WHEEL

This application claims priority from European patent application No. 17203600.6 filed on Nov. 24, 2017, the entire disclosure of which is hereby incorporated herein by reference.

FIELD OF THE INVENTION

The invention concerns a timepiece wheel set with a unidirectional wheel, arranged to rotate in only one direction in cooperation with a ratchet wheel, which is movable inside a ratchet wheel chamber, said wheel set including at least one click arranged to be attached to rotate integrally with said unidirectional wheel.

The invention also concerns a mechanism for winding at least one pair of timepiece barrels, comprising one such wheel set for winding each barrel.

The invention also concerns a watch including at least one such mechanism and/or at least one such wheel set.

The invention concerns the field of timepiece mechanisms, particularly for supplying power to timepieces, especially watches.

BACKGROUND OF THE INVENTION

Mechanisms for powering mechanical timepieces are often bulky and occupy a significant amount of space in the timepiece, especially in terms of thickness. Click mechanisms comprise springs which are difficult to assemble or handle in after sales service and take up space.

European Patent Application No EP2871534A1 in the name of ETA Manufacture Horlogère Suisse discloses a timepiece wheel set with a unidirectional wheel comprising integrated uncoupling means.

SUMMARY OF THE INVENTION

The invention proposes to develop a compact mechanism, especially in terms of thickness, for powering a watch.

To this end, the invention concerns a timepiece wheel set with a unidirectional wheel according to claim 1.

The invention also concerns a mechanism for winding at least one pair of timepiece barrels, comprising one such wheel set for winding each barrel.

The invention also concerns a watch including at least one such mechanism and/or at least one such wheel set.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
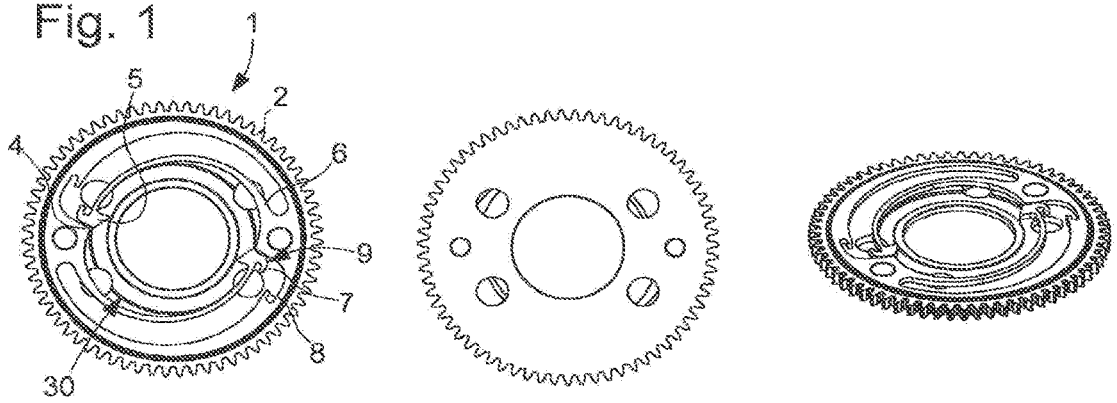
FIG. 1 represents schematic top, bottom and perspective views of a wheel set according to the invention, which includes a specific one-piece click, cooperating with a ratchet wheel which it surrounds.
Figure 2:
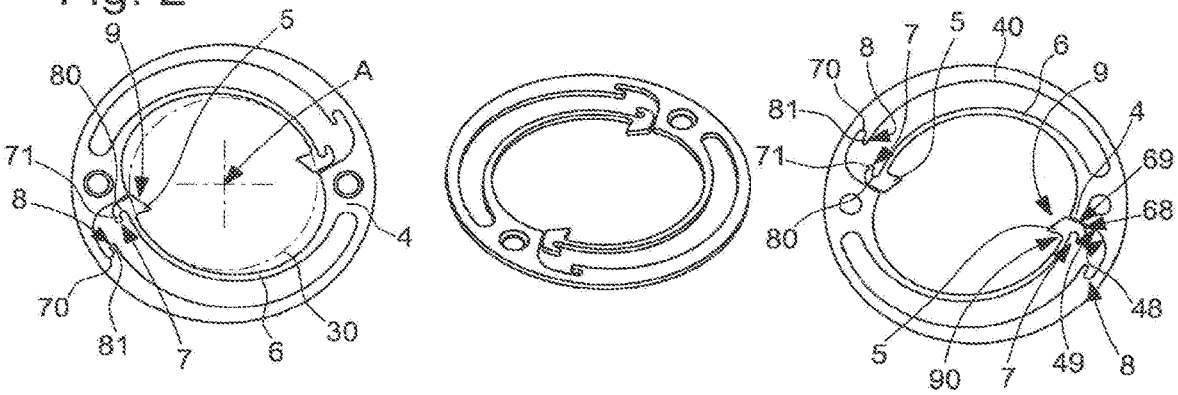
FIG. 2 represents schematic top, bottom and perspective views of this one-piece click, which includes strip springs, in a free position in which the strip springs are not stressed.
Figure 3:
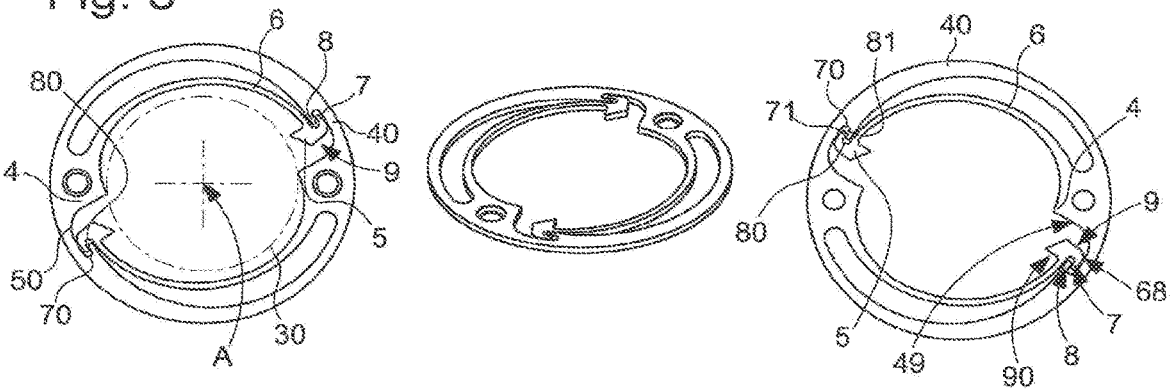
FIG. 3 represents a similar view to FIG. 2 of the same click in a position in which the strip springs are stressed.
Figure 4:
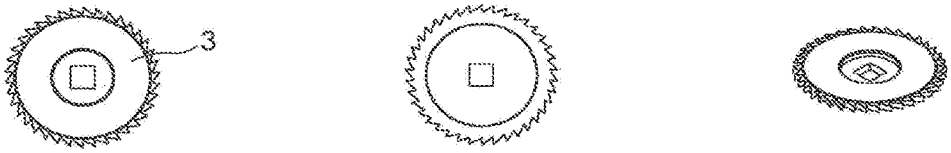
FIG. 4 shows, in a similar manner to FIG. 2, a ratchet wheel which cooperates with the click.
Figure 5:
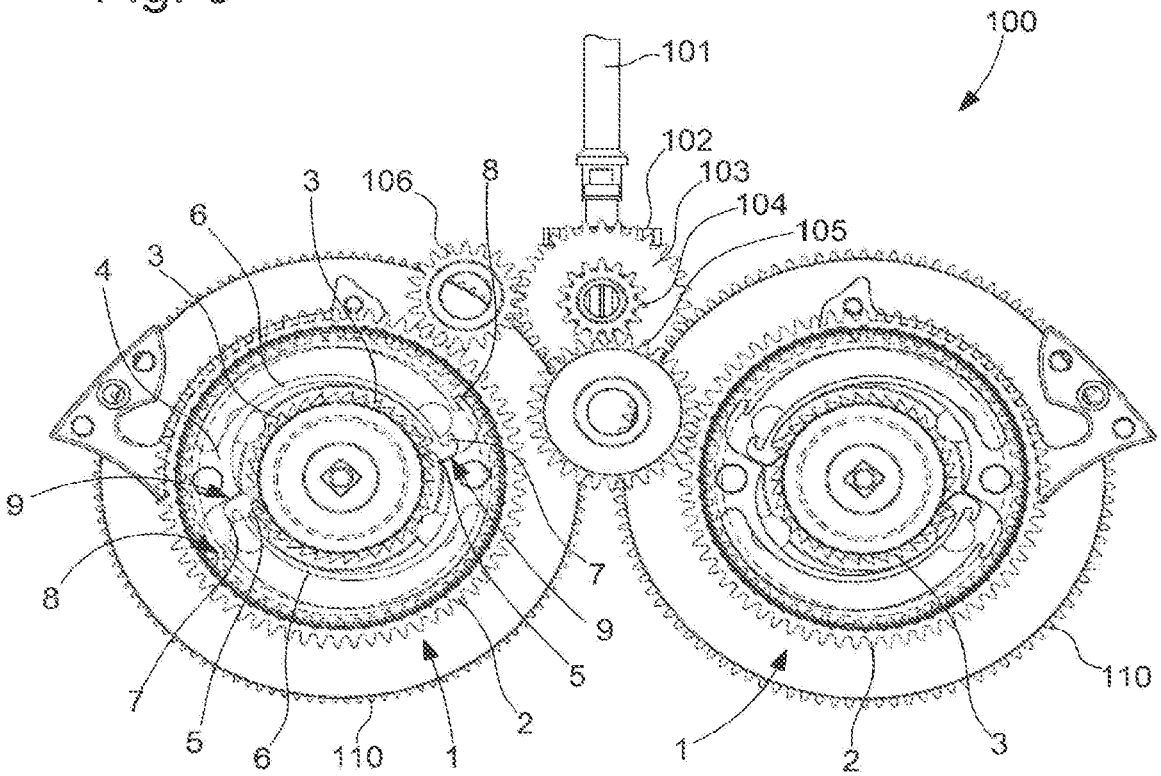
FIG. 5 represents a schematic, plan view of a mechanism for winding a pair of timepiece barrels, comprising one such wheel set for winding each barrel.
Figure 6:
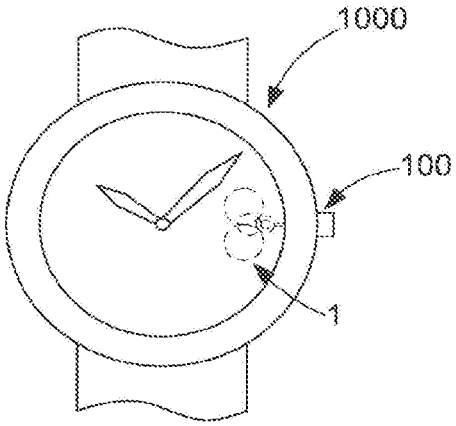
FIG. 6 represents a schematic, plan view of a watch including such a winding mechanism.

The invention concerns a timepiece wheel set 1 with a unidirectional wheel 2, arranged to rotate in only one direction in cooperation with a ratchet wheel 3 which is movable inside a ratchet chamber 30 represented in dot and dash lines in the Figures. This wheel set 1 includes at least one click 4, which is arranged to be attached to rotate integrally with unidirectional wheel 2.

According to the invention, click 4 forms a one-piece component comprising at least one spring-arm 6, at the head end 9 of which, on a first side, at least one beak 5 is arranged to cooperate directly with the toothing of a ratchet wheel 3 in an operating position in which spring-arm 6 is free. On a second side of spring-arm 6 at end 9 thereof, at least a first hook 7 is arranged to cooperate with a second hook 8 of complementary shape comprised in one-piece click 4, in a rest position in which spring-arm 6 is in an extended position. The elasticity of spring-arm 6 is adjusted to allow first spring 7 to be hooked or unhooked with respect to second hook 8, by the action of an operator or a manipulator, either by maximum elongation of spring-arm 6 along a length greater than that of the extended position, or by the tilting of end 9, or both by maximum elongation of spring-arm 6 and the tilting of end 9.

More particularly, this click 4 includes, perpendicular to each beak 5, which is substantially radially movable with respect to a click axis A, a recess 50 which is arranged to allow the complete radial uncoupling of beak 5 from a ratchet wheel 3.

More particularly, said click 4 includes a substantially annular portion 40 which includes, on each end 9, a first recess 70 arranged to house a first arm 71 of a first hook 7. Each spring-arm 6 includes at end 9 thereof a second recess 80 arranged to house a second arm 81 of a second hook 8.

Advantageously, recess 50 is located in substantially annular portion 40 of click 4 and is arranged to house spring-arm 6 with the head comprising beak 5 and first hook 7, and said recess includes a substantially radial bearing surface 49 in the variant of the Figures, against which a distal end face 69 of said head rests. This arrangement makes it possible to limit deformation of the strip spring in the movements driving the ratchet wheel.

More particularly still, ratchet wheel 3 has symmetry of order N with respect to a click axis A, wherein the number N is the number of strip springs 6 comprised in click 4.

In particular, click 4 is in made one piece with unidirectional wheel 2, and can, in particular, be made of a micromachinable material, like silicon or similar, by a LIGA or MEMS or similar process.

Figure 7:
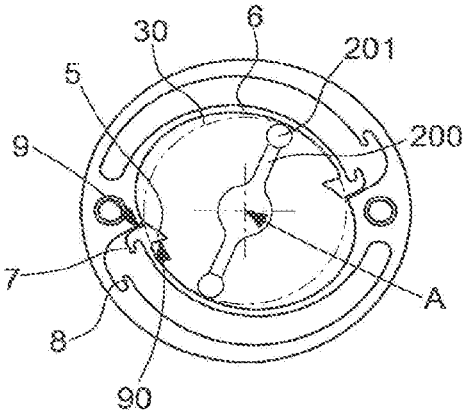
FIG. 7 represents a schematic, plan view of a tool for moving the click from the FIG. 2 position to the FIG. 3 position and vice versa.

In an advantageous embodiment, click 4 includes gripping means 90, which are arranged to cooperate simultaneously with a tool 20 having symmetry of order N with respect to a tool axis arranged to be centred on click axis A, and to simultaneously move beaks 5 away from click axis A beyond the reach of ratchet wheel 3 and ratchet chamber 30, in order, in particular, to perform an adjustment or a maintenance operation. FIG. 7 shows such a tool 200 including bosses 201 arranged to push back strip spring 6, and to rest on gripping means 90, composed here of a corner formed by the end of strip spring 6 underneath beak 5.

The invention also concerns a mechanism 100 for winding at least one pair of timepiece barrels 110 comprising, for winding each barrel 110, one such wheel set 1, whose click 4 is arranged to cooperate with a ratchet wheel 3 for driving an arbor of barrel 110. Wheel sets 1 are symmetrical with respect to each other and coplanar. Mechanism 100 includes drive means comprising an arbor 101, and a gear train including, in a non-limiting manner, a set of wheels 102, 103, 104, 105, and a reverser 106, arranged together to drive each unidirectional wheel 2 in a different direction, so that one ratchet wheel 3 is always driven, regardless of the direction in which the drive means are operated. Thus, arbor 10 makes it possible to wind one or other barrel 110, regardless of the direction of rotation of arbor 101, without requiring any uncoupling: in one direction click 4 winds the barrel, and in the other direction the same click 4 uncouples the same barrel 110.

More particularly, this mechanism 100 includes wheel sets 1, and a removable tool 200, having symmetry of order N with respect to a tool axis arranged to be centred on click axis A and to simultaneously move beaks 5 away from click axis A beyond the reach of ratchet wheel 3 and of ratchet wheel chamber 30 of each wheel set 1 in order to perform an adjustment or a maintenance operation.

The invention also concerns a watch 1000 including at least one such mechanism 100, and/or at least one such wheel set 1.

What is claimed is:

1. A timepiece wheel set with a unidirectional wheel, arranged to rotate in only one direction in cooperation with a ratchet wheel which is movable inside a ratchet wheel chamber, said wheel set comprising:

at least one click arranged to be attached to rotate integrally with said unidirectional wheel, wherein said click forms a one-piece component including at least one spring-arm, at the head end of which, on a first side, at least one beak is arranged to cooperate directly with the toothing of a said ratchet wheel in an operating position in which said spring-arm is free, and on a second side, at least a first hook is arranged to cooperate with a second hook of complementary shape comprised in said one-piece click, in a rest position in which said spring-arm is in an extended position, the elasticity of said spring-arm allowing said first hook to be hooked or unhooked with respect to said second hook by the action of a user or of a manipulator, either by maximum elongation of said spring-arm along a length greater than that of said extended position, or by the tilting of said end, or both by maximum elongation of said spring-arm and the tilting of said end.

2. The wheel set according to claim 1, wherein said click includes, perpendicular to each said beak, which is substantially radially movable with respect to a click axis, a recess arranged to allow the complete radial uncoupling of said beak from a said ratchet wheel.

3. The wheel set according to claim 1, wherein said click includes a substantially annular portion comprising, on each said end, a first recess arranged to house a first arm of a said first hook, and wherein each said spring-arm includes at the end thereof a second recess arranged to house a second arm of a said second hook.

4. The wheel set according to claim 1, wherein said ratchet wheel has symmetry of order N with respect to a click axis, wherein the number N is the number of said strip springs comprised in said click.

5. The wheel set according to claim 4, wherein said click includes gripping means arranged to cooperate simultaneously with a tool having symmetry of order N with respect to a tool axis arranged to be centred on said click axis and to simultaneously move said beaks away from said click axis beyond the reach of said ratchet wheel and of said ratchet wheel chamber, in order to perform an adjustment or a maintenance operation.

6. A mechanism for winding at least one pair of timepiece barrels, comprising:

the wheel sets according to claim 5, wherein said click is arranged to cooperate with a ratchet wheel for driving an arbor comprised in said barrel, said wheel sets being symmetrical with respect to each other and coplanar, and a removable tool, having symmetry of order N with respect to a tool axis arranged to be centred on said click axis and to simultaneously move said beaks away from said click axis beyond the reach of said ratchet wheel and of said ratchet chamber in order to perform an adjustment or a maintenance operation; and drive means and a reverser arranged together to drive each said unidirectional wheel in a different direction, so that one said ratchet wheel is always driven regardless of the direction in which said drive means operate.

7. The wheel set according to claim 1, wherein said click is in one piece with said unidirectional wheel.

8. A mechanism for winding at least one pair of timepiece barrels, comprising:

the wheel set according to claim 1 wherein said click is arranged to cooperate with a ratchet wheel for driving an arbor comprised in said barrel, said wheel sets being symmetrical with respect to each other and coplanar; and drive means and a reverser arranged together to drive each said unidirectional wheel in a different direction, so that one said ratchet wheel is always driven regardless of the direction in which said drive means operate.

9. A watch including at least one mechanism according to claim 8.

10. A watch including at least one timepiece wheel set according to claim 1.

* * * * *